United States Patent [19]

Bell et al.

[11] 4,090,368

[45] May 23, 1978

[54] OFFSHORE PLATFORMS

[75] Inventors: Arthur Oswald Bell, Woking; William Antony John Reardon Smith, Windelsham, both of England

[73] Assignees: Danbury Drilling Limited; Reardon Smith Exploration Limited, both of London, England

[21] Appl. No.: 638,327

[22] Filed: Dec. 8, 1975

[30] Foreign Application Priority Data

Dec. 19, 1974 United Kingdom ..... 55059/74

[51] Int. Cl.[2] ..... E02B 17/00

[52] U.S. Cl. ..... 61/93; 61/63; 175/85

[58] Field of Search ..... 61/46, 46.5; 175/85; 166/.5; 114/.5 D, 202

[56] References Cited

U.S. PATENT DOCUMENTS

| | | | |
|---|---|---|---|
| 2,831,448 | 4/1958 | Suderow | 114/202 |
| 2,848,722 | 8/1958 | Choporis | 114/202 |
| 2,910,834 | 11/1959 | Knaff | 61/46.5 |
| 3,189,093 | 6/1965 | Devries | 166/.5 |
| 3,528,497 | 9/1970 | Lehman | 175/7 |
| 3,653,354 | 4/1972 | Panaglia | 114/.5 D |
| 3,802,209 | 4/1974 | Weaver | 114/.5 D |
| 3,902,554 | 9/1975 | Hooper | 114/.5 D |

*Primary Examiner*—Paul R. Gilliam
*Assistant Examiner*—Alex Grosz
*Attorney, Agent, or Firm*—Lowe, King, Price & Markva

[57] ABSTRACT

An offshore platform including a deck with an aperture formed through it and a number of clamping means carried by the deck. The clamping means, which may comprise opposed doors, are mounted so as to be selectively movable between a retracted position, to leave the aperture freely open, and an extended position in which the clamping means extend into the aperture. The arrangement is to facilitate lowering and recovering heavy equipment such as a BOP stack.

12 Claims, 4 Drawing Figures

OFFSHORE PLATFORMS

The invention relates to offshore platforms and to such platforms from which heavy equipment is to be lowered and to be retrieved.

According to one aspect of the invention there is provided an offshore platform including at least one deck formed with an aperture therethrough and a plurality of clamping means carried by such deck, the clamping means being mounted so as to be selectively moveable between a retracted position, to leave said aperture freely open, and an extended position in which the clamping means extend into said aperture.

The clamping means may comprise a plurality of slidably mounted doors, preferably a pair of opposed doors.

The clamping means may be mounted by wheels or rollers on tracks carried by the deck and such wheels or rollers may be captive on the tracks.

The clamping means may be actuable between their extended and retracted positions by fluid actuated ram means. The respective fluid actuated ram means of the various clamping means may include accumulators to absorb shock loads and dampen, in use, oscillation of a device being raised through said aperture in the deck. Throttle means may be connected with said ram means to control said damping. Said fluid actuated ram means may each be gimbal mounted.

The inner edges or ends of the clamping means adjacent said aperture may have shock absorbing means carried thereon.

Stop means and/or shock absorbing means may be provided at the outer or rear of said clamping means.

Two such decks may be located one above the other with apertures in alignment.

Latch means may be provided for retaining the clamping means in their retracted and/or extended positions.

Means may be provided for manual operation of the clamping means between the retracted and extended positions.

The foregoing and further features of the invention may be more readily understood from the following description of a preferred embodiment thereof, by way of example; with reference to the accompanying drawings, in which.

Figure 1:
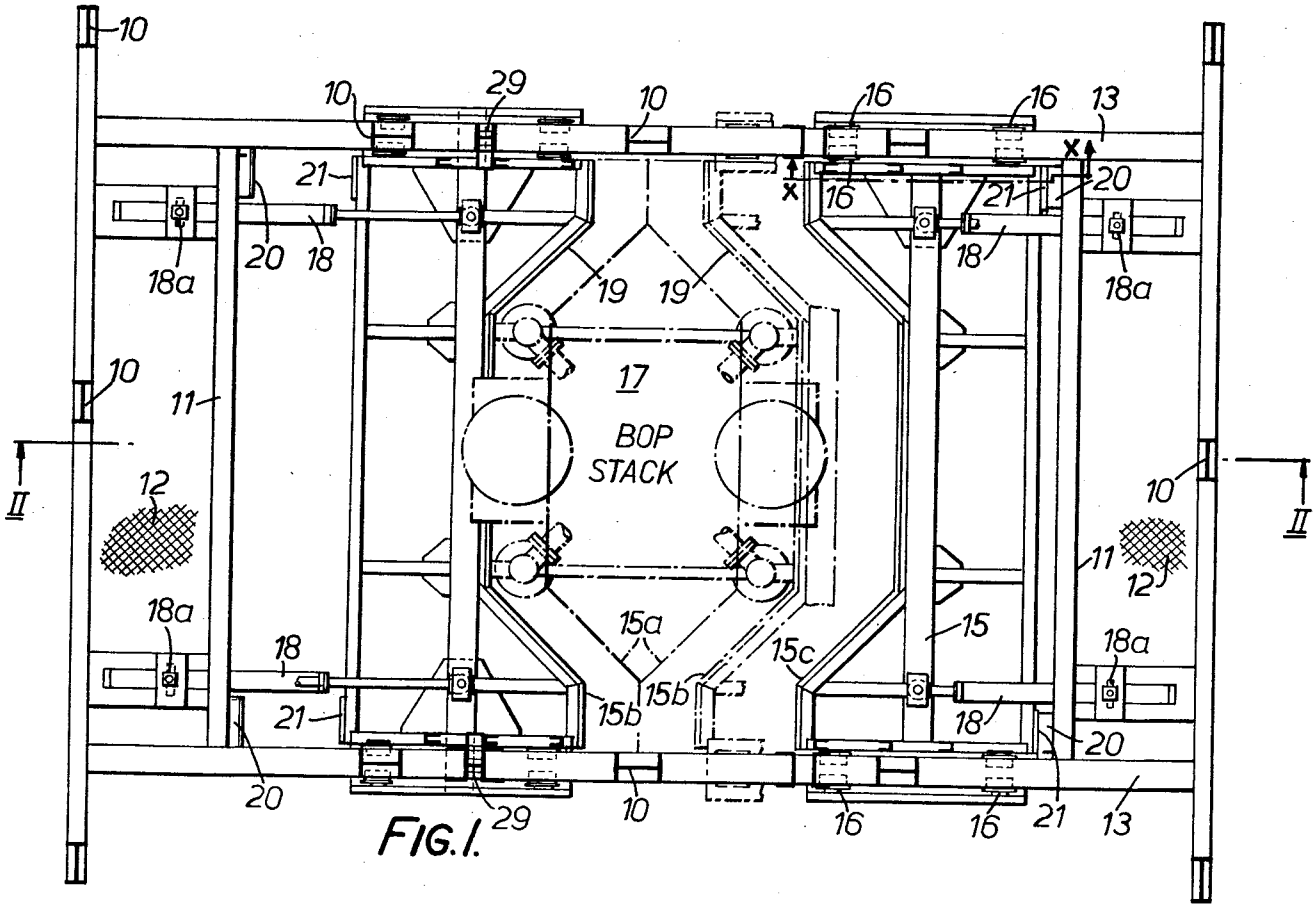
FIG. 1 is a plan view of a deck of an offshore platform.
Figure 2:
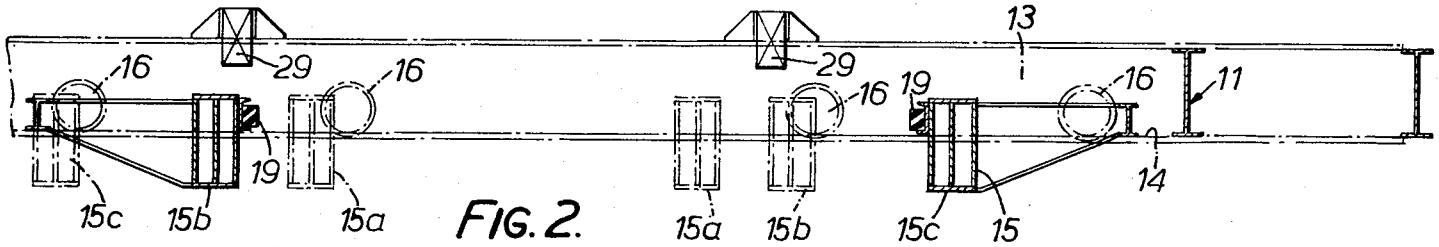
FIG. 2 is a side sectional view of part of FIG. 1 along line II—II of FIG. 1.
Figure 4:
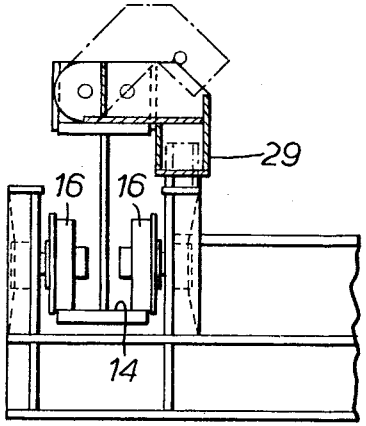
FIG. 4 is a scrap view illustrating a door latch of FIG. 1.
Figure 3:
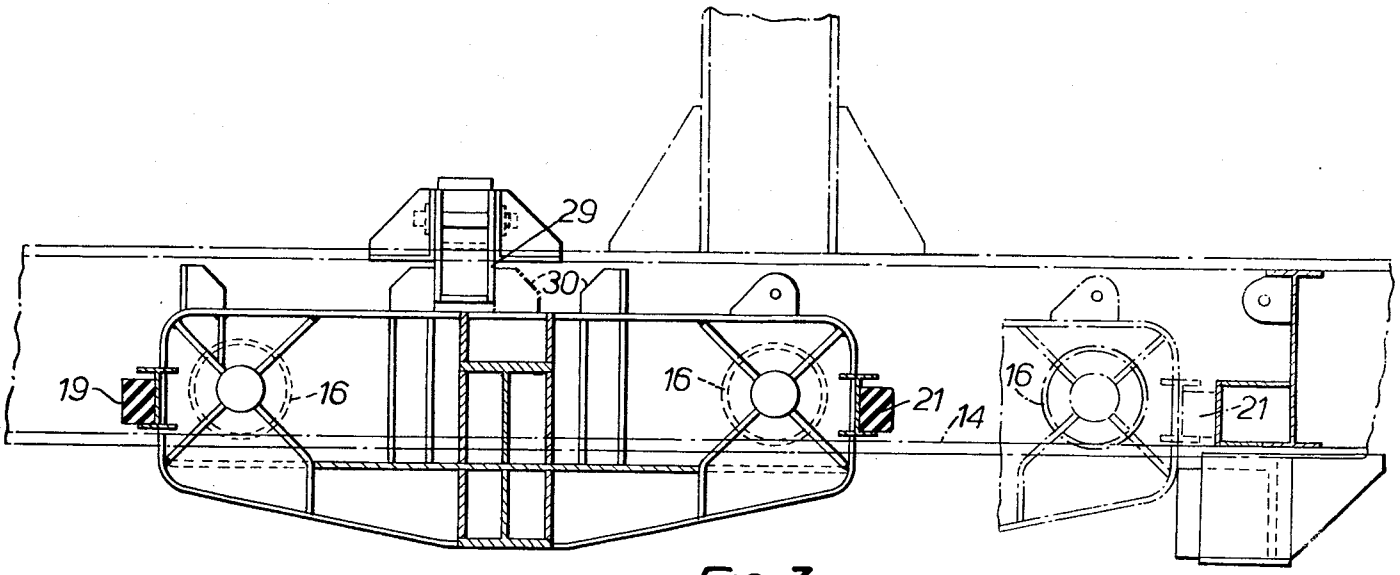
FIG. 3 is a side sectional view along line X—X of FIG. 1.

Referring now to the drawings there is shown a so-called cellar deck which is carried on hangers 10 from an upper deck (not shown) of an offshore platform. The cellar deck comprises a framework 11 of metal members with a grill flooring 12 located thereon.

The framework 11 includes members 13 each carrying or comprising a track or rail 14. Two doors 15 are mounted on the tracks 14 by wheels 16 so as to be moveable in opposed directions. The wheels 16 are held captive on tracks 14 as shown. Each of the doors 15 is moveable from an extended position shown dotted at **15*a* in FIG. 1 through a clamping position 15*b* to a retracted position 15*c* to leave an aperture 17 in the deck open to allow passage of equipment, such as a Blow Out Preventer (BOP) stack (FIG. 1**).

The doors 15 are moveable under control of fluid actuated rams 18 mounted by gimbal mountings **18*a* on framework 11 and attached at their pistons to doors 15. Shock absorbing material 19 is located around the inner edges of doors 15. Back stops 20 and/or shock absorbers 21 are provided at the rears of doors 15. Latch members 29 are plurally carried on the framework 11 and can be engaged manually with lugs or openings 30 carried on doors 15 to lock the doors 15** in their extended or retracted positions.

In use when it is required to lower equipment such as a BOP to the sea bed during drilling, the base of the BOP is lowered from the upper deck to rest on the doors 15 in the extended position **15*a* shown in FIG. 1. The BOP is then lowered on to its base. The whole assembly is then raised slightly and the doors 15 retracted to position 15*c***. The BOP assembly is then lowered to the sea bed.

During recovery of the BOP and when passing through the air/water interface wave action causes the BOP to oscillate like a pendulum. When the upper portion of the BOP is within the aperture 17 the doors 15 are then moved from the retracted position **15*c* to the clamping positions 15*b* to clamp the BOP and steady it. The doors 15 are then retracted to position 15*c* and the BOP raised above the doors 15. The doors 15 are then moved to the extended position 15*a*** and the BOP can be lowered to rest thereon.

The rams 18 may include accumulators to absorb shock loads and connected with throttle means to control damping.

With present day drilling equipment a BOP can weigh up to 250 tons and recovery is difficult and hazardous to both personnel and equipment. The arrangement shown and described will considerably assist with these problems.

Various modifications can be made within the scope of the invention, for example, the doors 15 could be replaced by separate clamping members; there could be a further pair of doors on an upper or lower deck arranged to move in a direction normal to the direction of movement of doors 15; with a circular opening 17 there could be three doors or clamping assemblies arranged 120° apart and for safety reasons manual means would be provided for moving the doors 15 in the event of a power failure to rams 18.

What is claimed is:

1. An offshore platform that enables heavy equipment to be raised and lowered and held in situ in an intermediate position comprising a deck with an aperture therethrough, a pair of clamping and support members slidably mounted on said deck, said clamping and support members having ends adjacent the aperture for selectively clamping the equipment in situ when the equipment is positioned in the aperture, a separate fluid actuated ram means associated with each of said clamping and support members for driving the ends of said clamping and support members so they are selectively moved: (a) away from each other into a retracted position clear of said aperture, (b) toward each other into an extended position in which said clamping support members extend into said aperture to form a platform for supporting the heavy equipment to be lowered through said aperture, and (c) towards each other into an intermediate position within said aperture in which the ends engage and support heavy equipment extending through said aperture; and latch means for retaining said clamping and support means in their retracted and extended positions, respectively.

2. An offshore platform as claimed in claim 1 wherein said clamping means comprise a plurality of slidably mounted doors.

3. An offshore platform as claimed in claim 2 wherein said doors comprise a pair of opposed doors.

4. An offshore platform as claimed in claim 1 wherein the clamping means are mounted by wheels on tracks carried by the deck.

5. An offshore platform as claimed in claim 4 wherein said wheels are captive on the tracks.

6. An offshore platform as claimed in claim 1 wherein the respective fluid actuated ram means of the clamping means contain hydraulic accumulators to dampen, oscillation of the equipment as it is being raised through said aperture in the deck.

7. An offshore platform as claimed in claim 6 including throttle means connected to control said damping.

8. An offshore platform as claimed in claim 1, wherein said fluid actuated ram means are each gimbal mounted.

9. An offshore platform as claimed in claim 1 wherein the clamping means has inner edges adjacent said aperture, said edges having shock absorbing means carried thereon.

10. An offshore platform as claimed in claim 1 wherein stop means are located at the outer edges of said clamping means.

11. An offshore platform as claimed in claim 1 including two said decks located one above the other with their apertures in alignment.

12. An offshore platform as claimed in claim 1 including means for manual operation of the clamping means between the retracted and extended positions.

* * * * *